US007082652B2

(12) United States Patent
St-Louis et al.

(10) Patent No.: US 7,082,652 B2
(45) Date of Patent: Aug. 1, 2006

(54) CLASP, LACE WITH A CLASP, AND A SHOE WITH A LACE AND CLASP

(75) Inventors: Julie St-Louis, Veyrier-du Lac (FR); James Burress, Irvine, CA (US)

(73) Assignee: Salomon S.A., Metz-Tessy (FR)

( * ) Notice: Subject to any disclaimer, the term of this patent is extended or adjusted under 35 U.S.C. 154(b) by 12 days.

(21) Appl. No.: 10/841,559

(22) Filed: May 10, 2004

(65) Prior Publication Data

US 2004/0226151 A1 Nov. 18, 2004

(30) Foreign Application Priority Data

May 13, 2003 (FR) ..... 03 05733

(51) Int. Cl.
*A43C 7/00* (2006.01)

(52) U.S. Cl. ..... 24/715.4; 36/50.1

(58) Field of Classification Search ..... 24/128, 24/265 EC, 587.11, 664, 715.4, 465, 470, 24/615, DIG. 51; 63/3.1; 36/50.1
See application file for complete search history.

(56) References Cited

U.S. PATENT DOCUMENTS

| | | | | |
|---|---|---|---|---|
| 544,349 | A | 8/1895 | Burgin | |
| 911,573 | A | 2/1909 | Crooks | |
| 1,014,506 | A * | 1/1912 | Morgan | 24/128 |
| 1,284,972 | A | 11/1918 | Anthony | |
| 1,982,438 | A * | 11/1934 | Keidel | 24/128 |
| 2,009,330 | A | 7/1935 | Tate | 24/143 |
| 2,451,247 | A | 10/1948 | Sims | 24/117 |
| 5,138,855 | A * | 8/1992 | Faris | 63/3.1 |
| 5,379,496 | A * | 1/1995 | Krauss | 24/615 |
| 5,477,593 | A | 12/1995 | Leick | 24/712.5 |
| 5,566,474 | A | 10/1996 | Leick et al. | 36/50.1 |
| 5,634,244 | A * | 6/1997 | Fetsch et al. | 24/DIG. 51 |
| 5,782,107 | A * | 7/1998 | Glanz | 63/3.1 |
| 6,146,049 | A * | 11/2000 | Faris | 403/326 |
| 6,357,261 | B1 * | 3/2002 | Cheng | 63/3.1 |
| 2001/0025434 | A1 | 10/2001 | Fellouhe | 36/50.1 |

FOREIGN PATENT DOCUMENTS

| | | |
|---|---|---|
| FR | 2706743 | 12/1994 |
| FR | 2706744 | 12/1994 |
| FR | 2772244 | 6/1999 |

* cited by examiner

*Primary Examiner*—Robert J. Sandy
(74) *Attorney, Agent, or Firm*—Greenblum & Bernstein, P.L.C.

(57) ABSTRACT

A clasp particularly for a cord or lace. The clasp can be used in connection with shoe laces or tightening cords for various garments, for example. The clasp has a male portion and a female portion having mutual connecting structures. Each of the male and female portions has a structure for connecting to an associated end of the cord/lace, and the male and female portions have complementary guiding structures so as to facilitate their engagement/disengagement.

33 Claims, 3 Drawing Sheets

1
6
2
2b
2a
III
3
5
4
III

CLASP, LACE WITH A CLASP, AND A SHOE WITH A LACE AND CLASP

CROSS-REFERENCE TO RELATED APPLICATION

This application is based upon French Patent Application No. 03.05733, filed May 13, 2003, the disclosure of which is hereby incorporated by reference thereto in its entirety and the priority of which is hereby claimed under 35 U.S.C. §119.

BACKGROUND OF THE INVENTION

1. Field of the Invention

The invention relates to a clasp, especially a clasp for a cord or lace, adapted more particularly to a lacing system, such as for an article of footwear of the type in which the lace forms a closed loop.

2. Description of Background and Relevant Information

Lacing systems of the aforementioned type are known, for example, in French Patent Publication No. 2 706 744 and U.S. Pat. No. 5,566,474. The disclosure of these documents is directed to a lacing system in which the ends of the lace are anchored at the end of a lacing zone of a boot, passing alternately through a series of keepers/guides arranged along the lacing zone, and ending with a loop, that is, a traction loop, on which a blocker for the lace is threaded. In such a construction, the tightening of the boot is accomplished by pulling on the loop and by blocking the sliding of the lace by means of the blocker once the desired tension is reached.

In other similar embodiments, the lace forms a fully closed loop, as the ends of the lace are assembled by stitches in order to form a traction loop. With this type of construction in which the lace forms a closed loop, it becomes difficult for the user to reconstitute the lacing system if the lace were to break. Indeed, at such times, means to enable the wearer to join together the two ends, such as by stitching, typically are not readily available.

This problem is further increased for laces that are very narrow and ones having a low-friction coating on their outer surfaces, as is the case, for example, of the so-called KEVLAR® laces used in the so-called quick-lacing systems that are even more difficult to sew.

Another drawback that occurs in lacing systems in which the lace forms a traction/gripping loop is that the loop poses a safety problem. Indeed, the loop can become caught in branches, obstacles, etc., and cause a runner to fall, or even become caught unfortunately inside of a boat, canoe, kayak, etc., which can be particularly dangerous when engaged in water sports in which the boat can overturn with the user caught in the boat by the laces. This drawback was partially resolved in the commonly owned French Patent Publication No. 2 772 244 and U.S. Patent Application Publication No. 2001/0025434, by providing a pocket for storing the lace loop and the associated blocker. However, even with such a pocket one can occasionally experience the loop and blocker accidentally being pulled out or become free from the pocket.

SUMMARY OF THE INVENTION

An object of the present invention is to overcome the aforementioned drawbacks and to provide a clasp, especially for a cord or lace, adapted more particularly to a system for connecting the two ends of a lace, which is easy to use, particularly in case the lace breaks, and which can be undone quickly in a dangerous situation.

Another object of the present invention is to propose a clasp that, if needed, can be opened and closed easily.

This object is achieved in the clasp according to the invention, especially for a cord or a lace, in that it has a male portion and a female portion with mutual connecting structures, in that each male/female portion has a structure for connecting to an associated end of the cord/lace, and in that each male/female portion has mutual guiding structures so as to facilitate their engagement/disengagement.

The connecting system of the invention allows the lace to be replaced/repaired easily in case of breakage, since the loop can be reformed very simply by using the system for connecting the ends. According to a preferred embodiment, the mutual connecting structure is of the friction coupling type.

The fact that the connecting system functions by friction also offers safety, as it will open in the case of a substantial force.

BRIEF DESCRIPTION OF THE DRAWINGS

The invention will be better understood and other characteristics thereof will become apparent from the following description given with reference to the attached schematic drawings showing, by way of a non-limiting example, a particular embodiment of the invention, and in which.

DETAILED DESCRIPTION OF THE INVENTION

Figure 1:
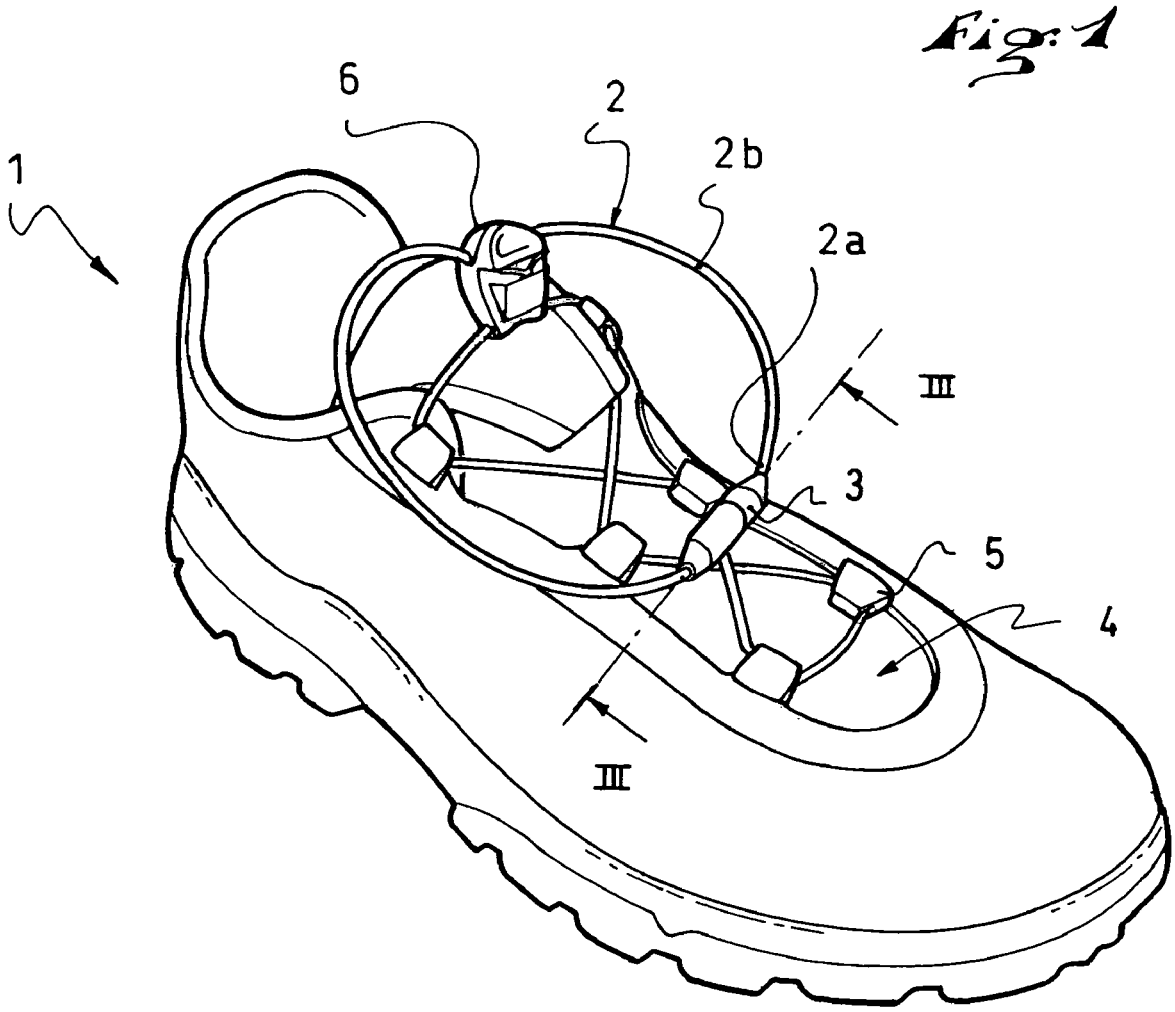
FIG. 1 is a perspective view of a shoe with a lacing system incorporating a clasp according to the invention, the clasp being in the closed position.

FIG. 1 shows a shoe 1 provided with a lace 2 equipped with a clasp 3, according to the invention. The invention is contemplated to be used with laces, cords, strings, cables, and filiform elements of various types, including those having various sizes, cross-sectional shapes, and made of various materials or combinations of materials. The use of the term lace in this description is not to be considered as limiting the invention to a particular element or type of element.

The lace 2 passes alternately through a series of keepers/guides 5 arranged on both sides of an opening 4 of an upper of a shoe for fitting the shoe upon the foot, the ends 2*a* of the lace being connected together by the clasp 3.

A known lace blocker 6 is mounted on the two lace strands in the area of the upper end of the opening 4 for fitting the boot, so as to block the sliding of the lace 2 when the desired tightening tension is reached. This blocker is disclosed in French Patent Publication No. 2 706 743 and in U.S. Pat. No. 5,477,593, the disclosure of the latter of which is hereby incorporated-by-reference thereto in its entirety. Another type of blocker could also be used within the scope of the invention.

The portion of the lace 2 located beyond the blocker 6, that is, on the side of the blocker remote from the lacing zone, forms a closed loop 2*b*, also referred to as a traction loop. The loop 2*b* permits one to exert a necessary manual traction/pulling force for tightening the boot 1, the clasp 3 simultaneously acting as a means for connecting the ends 2*a* of the lace and as an element for distributing pressure to exert a force on the traction loop 2*b*.

Figure 2:
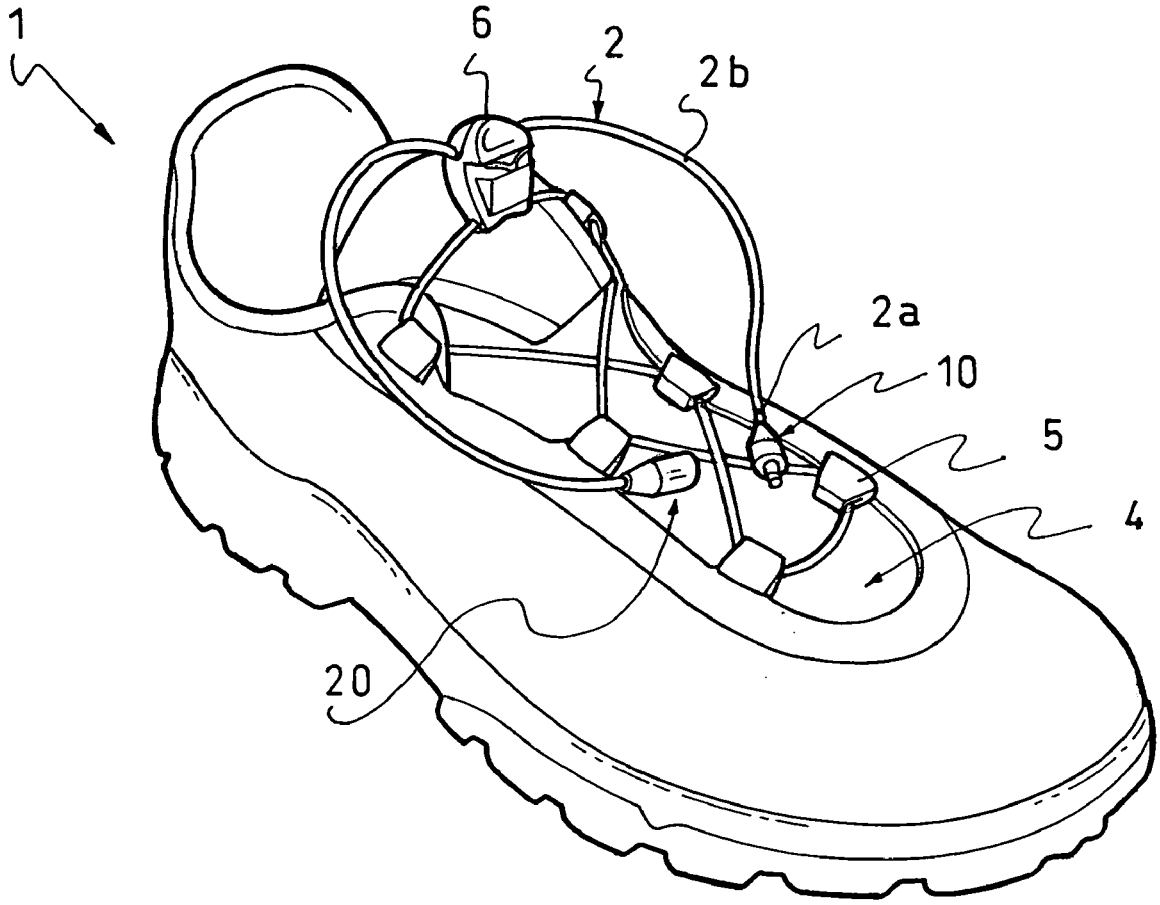
FIG. 2 is a view, similar to FIG. 1, showing the clasp in the open position.

FIG. 2 shows the same shoe 1 with the clasp 3 open. The lace 2 can be a round lace, that is, a lace having a circular cross section, although the invention is not to be limited to this particular shape.

Alternatively, the lace could be flat or generally flat, such as one having a rectangular transverse cross section or an oval cross section.

The lace can have a more or less substantial diameter. In the case shown in the drawing figures, the lace is shown to have a relatively small diameter, on the order of 1.5 millimeters (mm). Also, according to the invention, the lace can be made of a strong material, such as aramid fibers. Alternatively, the lace could be a cord of the types used for tightening jackets, such as around the waist and sleeves of the wearer, for example, and for other garments.

A clasp 3 according to the invention is shown in greater detail in FIGS. 3–6.

The clasp 3 is formed of a male portion 10 and a female portion 20 each having an outer envelope 17, 27, respectively. Each male 10/female 20 portion has identical structures 11, 21, respectively, for connecting to an associated end 2*a* of a lace/cord 2, as well as mutual guide and connection structures 15, 16; 25, 26, respectively, that are described below.

The lace-end connecting structures 11, 21 each have an opening channel 12, 22, respectively, having a cylindrical shape with a diameter dl equal to or slightly greater than the diameter of the lace 2 so as to allow for the passage of the lace within the channels. Other channel shapes are possible as well, such as for conforming to the cross-sectional shape of the lace being used.

If the lace 2 has a flat shape, each channel 12, 22 could have an associated shape, for example, a rectangular shape, with appropriate dimensions. Each channel 12, 22 opens, on the one hand, to the outside of the associated male/female portion through an opening 12*a*, 22*a*, respectively, with the same dimensions and, on the other hand, to the inside of the associated male/female portion by a shoulder 13, 23, respectively, in a first cavity 14, 24, respectively, with larger dimensions than those of the channels. For the sake of providing a frame of reference, the "outside" of the male and female portions of the clasp, where openings 12*a* and 22*a* are positioned, can be regarded as the distal ends of the clasp, whereas the center of the closed clasp, or the "inside" ends of the male and female portions of the clasp, can be regarded as the proximal ends of the clasp.

In the case shown, the cavities 14, 24 are also cylindrical with a diameter d2 that is sufficient for receiving a knot 2*c*, or other enlargement, formed at each end 2*a* of the lace 2. If the lace 2 is of the flat type, the cavities 14, 24 could have an appropriate form.

Figure 5:
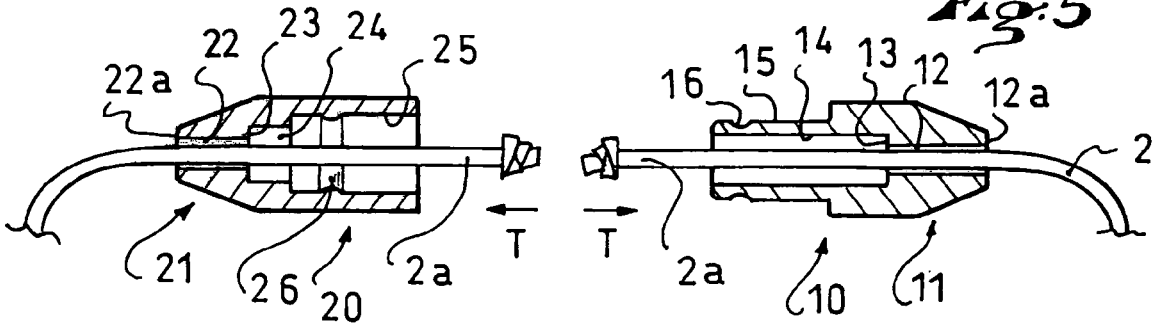
FIGS. 5 and 6 are views, similar to FIG. 4, showing the positioning of the ends of the lace in the clasp.
Figure 6:
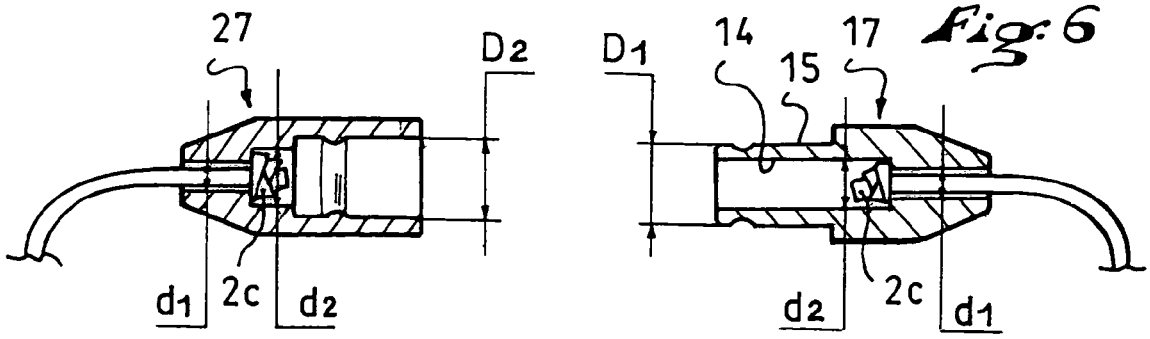

As shown in FIGS. 5 and 6, the combination of channels 12, 22 and shoulders 13, 23 essentially ensures the connection of each male/female portion 10, 20 to an associated end, respectively, of the lace 2. Indeed, it suffices to pass each of the ends 2*a* through the associated connection channel 12, 22, respectively, from the outside, or from the distal ends, then to make a knot 2*c* at the end of the lace.

Through traction on the lace 2 in the direction T, i.e., in the direction from the proximal end to the distal end, each knot 2*c* abuts against the associated shoulder 13, 23, respectively, thus achieving the connection of the male 10, female 20 portion to the end 2*a*.

The guiding structure of the male portion 10 includes a sleeve 15, having a transverse dimension D1 and a length L1, and extending opposite the connection elements 12, 13, in the longitudinal direction.

The sleeve 15 preferably has a cylindrical shape with a diameter Dl, but it could also have another outer shape, for example, a parallelepipedic form, that is, a square or rectangular cross section, or an oval shape.

Furthermore, a first cavity 14 extends through the sleeve 15 so as to allow the passage of the end 2*a* of the lace 2.

The sleeve 15 has a length L1 in the longitudinal direction which is at least equal to the dimension D1 so as to provide guiding and to facilitate its engagement/disengagement from the female portion 20.

Nonetheless, L1 is preferably equal to at least twice the value of D1 so as to have optimal guiding conditions.

Lastly, the sleeve 15 has a friction groove 16 at its free end or at the proximal end of the male portion 10, that is, at the end opposite the connection structure 11. This groove 16 can extend completely around the periphery of the sleeve 15, or it can be constituted of discrete peripheral groove segments.

The mutual guide and connection structure of the female portion 20 of the clasp includes a second cavity 25 extending opposite the lace-end connection structure 21. This second cavity 25 is adapted to receive and house the sleeve 15 of the male portion 10 and therefore has a transverse dimension D2 and a length L2 that are complementary to those D1, L1 of the sleeve 15. In this case, D2 and L2 are slightly greater than the dimensions D1, L1.

The cavity 25 also has a geometry that is complementary to that of the sleeve 15, such as cylindrical, but which could also be parallelepipedic or otherwise depending on the form of the sleeve 15.

In the case shown, the cavity 25 has a diameter D2 or a transverse dimension greater than that d2 of the first cavity 24. However, these two dimensions could be identical, the first cavity 24 then merging with the cavity 25.

At its end located on the side of the first cavity 24, the cavity 25 has a rib or projection 26 adapted to cooperate with the groove 16 of the sleeve 15 for snapping the male portion into the female portion, that is, for making a friction-fitted connection.

As mentioned previously with regard to the groove, the rib 26 can extend completely around the surface of the cavity 25 or it can be constituted of discrete peripheral segments.

The embodiments of the invention with the male/female portions having complementary cylindrical geometrical forms and friction-fit structures of the rib/groove, peripheral or annular/circular type have the advantage of allowing a mutual rotation of the male/female portions after assembly. The closed clasp is therefore less susceptible to the creation of tension in the area of the lace/cord, for which it allows the ends to connect.

The friction-fit shapes could be distributed in the opposite manner, as well. That is, the groove could be on the female portion and the rib could then be on the male portion, without leaving the scope of the invention.

The friction-fit mechanism allows for an easy coupling of the male/female portions of the clasp and also allows for a safety uncoupling when, for instance, the lace loop were to be caught or snagged by an obstacle. The mutual guide and connection structures are important for allowing an easier engagement/disengagement of the male/female portions of the clasp.

The mutual guide and connection structures, such as the lengths of the sleeve and the cavity, could nevertheless be decreased, even possibly omitted, for example, for reasons of bulkiness, if a safety/releasing feature were to be preferred.

Figure 3:
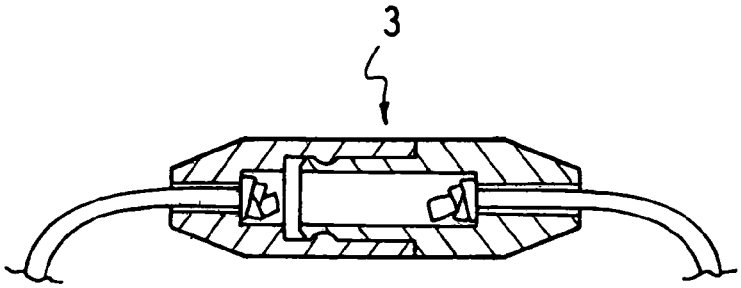
FIG. 3 is a cross-sectional view of the clasp and portions of the lace, taken along the line III—III of FIG. 1.
Figure 4:
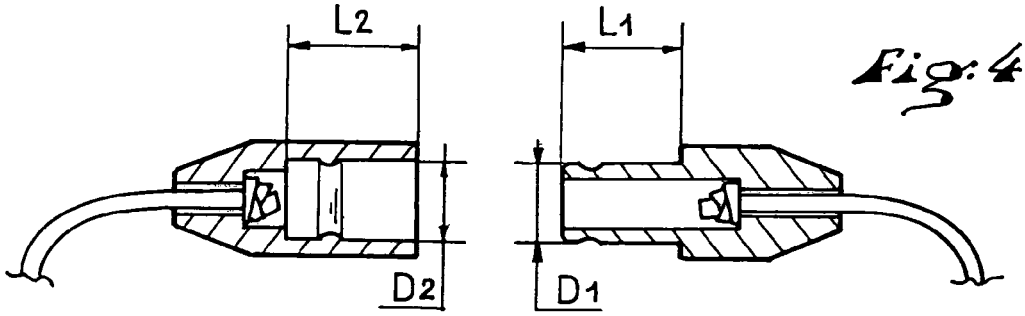
FIG. 4 is a view, similar to FIG. 3, of the clasp in the open position.

As can be seen in FIG. 3 in particular, when the clasp is closed, it has a generally uniform outer surface, since the male and female portions have identical, or generally the same, transverse cross-sectional dimensions. This reduces the likelihood that the clasp could become snagged by an obstacle, such as shrubbery or other material during a walk or run. FIG. 3 shows the proximal end of the female portion 20 abutting against a facing surface of the male portion 10 of the clasp at a transverse peripheral junction line of the closed clasp.

In addition, because of the provision of a uniform, or substantially uniform surface, particularly at the junction between the outer surfaces of the male and female portions of the clasp, the closed clasp provides a more comfortable gripping member as one were to tighten the lace upon the shoe, such as just prior to setting the blocker 6. In this same regard, in the embodiment shown, the closed clasp 3 has a larger cross-sectional dimension than the lace 2. For the purpose of providing a comfortable grip, the relative difference in dimensions as shown can be maintained or even increased.

Similarly, by providing a tapered shape for the respective distal ends of the male and female portions of the clasp, as shown in all of the drawing figures, particularly for embodiments in which the cross-sectional dimension of the clasp is significantly greater than that of the lace or cord, again the likelihood of the clasp becoming dislodged by impacts or entanglements with objects is reduced.

In any event, the present invention is particularly advantageous for the described application to a lace for a boot or shoe.

However, the clasp according to the invention can be used for other applications in which the same or similar drawbacks of safety and/or ease of use are important. For example, the clasp can be used for connecting an end of a cord, for instance, of a glove, to a sleeve, so as to provide a releasable connection mechanism that is easy to use due to the guiding structures provided.

The invention claimed is:

1. A clasp for a cord or lace, said clasp comprising:

a male portion; and a female portion;

each of the male and female portions including a cord-end/lace-end connection structure;

the male and female portions including mutual connection structures for engagement and disengagement of the male and female portions, the connection structures thereby providing a releasable connection for the clasp;

the male and female portions including complementary guiding structures for facilitating movement of the male and female portions into engagement and out of engagement, so as to close and open the clasp, respectively;

the guiding structure of the female portion comprising a longitudinally extending cavity;

the guiding structure of the male portion comprising a longitudinally extending sleeve adapted to be inserted and retained within said cavity of said female portion;

the length of the sleeve of the male portion being greater than or equal to an outermost transverse dimension of the sleeve of the male portion.

2. A clasp according to claim 1, wherein:

the mutual connecting structures are of a friction-fit type.

3. A clasp according to claim 1, wherein:

the cord-end/lace-end connection structure of each of the male and female portions comprises a respective channel for passage of the cord or lace;

each of the channels open into a respective first cavity at a respective shoulder, the shoulder of each of the male and female portions having a transverse cross section greater than the transverse cross section of the respective channels, and each of the shoulders having a size capable of supporting a knot formed in an associated lace-end.

4. A clasp according to claim 3 in combination with a cord or lace, wherein:

each of the channels has a transverse cross section corresponding to a transverse cross section of the cord or lace.

5. A clasp according to claim 1, wherein:

said male and female portions have respective envelopes with the same outermost transverse cross-sectional dimension.

6. A clasp according to claim 1, wherein:

each of said male and female portions has an envelope having the same outermost cross-sectional dimension at least at a junction area between outer surfaces of said male and female portions in a closed/engaged position of the clasp.

7. A clasp according to claim 6, wherein:

the distal end of the envelope of each of the male and female portions has a tapered shape.

8. A clasp according to claim 1, wherein:

each of said male and female portions has an envelope having tapered distal ends.

9. A clasp according to claim 1, wherein:

said complementary guiding structures for facilitating movement of the male and female portions into engagement and out of engagement, so as to close and open the clasp provide for a releasable connection for the clasp.

10. A clasp according to claim 1, wherein:

in a closed position of the clasp, the female portion has a proximal end in abutment against a facing surface of the male portion of the clasp at a transverse peripheral junction line.

11. A clasp for a cord or a lace, said clasp comprising:

a male portion; and a female portion;

each of the male and female portions including a cord-end/lace-end connection structure;

the male and female portions including mutual connection structures for connecting together the male and female portions;

the male and female portions including complementary guiding structures for facilitating movement of the male and female portions into engagement and out of engagement, so as to close and open the clasp, respectively;

the guiding structure of the male portion comprising a longitudinally extending sleeve having a length less than an entirety of a length of the male portion, the sleeve being spaced from a distal end of the male portion, the sleeve also having an outermost transverse dimension;

the guiding structure of the female portion comprising a longitudinally extending cavity having a length less than an entirety of a length of the female portion, the cavity being spaced from a distal end of the female portion, the cavity also having a transverse dimension;

the transverse dimension of the female portion being complementary to the outermost transverse dimension of the sleeve of the male portion; and the length of the cavity of the female portion being complementary to the length of the sleeve of the male portion to facilitate insertion of the male portion into the female portion;

the length of the sleeve of the male portion being at least equal to the outermost transverse dimension of the sleeve of the male portion; and the length of the cavity of the female portion being at least equal to the transverse dimension of the cavity of the female portion.

12. A clasp according to claim 11, wherein:

the length of the sleeve of the male portion is equal to approximately twice the transverse dimension of the sleeve of the male portion; and the length of the cavity of the female portion is equal to approximately twice the transverse dimension of the cavity of the female portion.

13. A clasp according to claim 11, wherein:

the sleeve of the male portion has a cylindrical shape, said transverse dimension of the sleeve of the male portion being an outer diameter of said cylindrical shape; and the cavity of the female portion has a cylindrical shape.

14. A clasp according to claim 11, wherein:

the mutual connection structures of the male and female portions comprise:

at least one rib on the male portion and at least one groove on the female portion; or at least one groove on the male portion and at least one rib on the female portion.

15. A clasp according to claim 11, wherein:

the mutual connection structures of the male and female portions comprise:

at least one rib on the sleeve of the male portion and at least one groove within the cavity of the female portion; or at least one groove on the sleeve of the male portion and at least one rib within the cavity of the female portion.

16. A clasp according to claim 15, wherein:

the mutual connection structure of each of the male and female portions extends around entire transverse peripheries of the sleeve and cavity.

17. A clasp according to claim 11, wherein:

said transverse dimension of the sleeve of the male portion is an outer transverse dimension of the sleeve.

18. A clasp according to claim 11, wherein:

said complementary guiding structures for facilitating movement of the male and female portions into engagement and out of engagement, so as to close and open the clasp provide for a releasable connection for the clasp.

19. A clasp according to claim 11, wherein:

in a closed position of the clasp, the female portion has a proximal end in abutment against a facing surface of the male portion of the clasp at a transverse peripheral junction line.

20. A connection system comprising:

a cord or lacing comprising at least a first cord/lace end and a second cord/lace end;

a clasp for connecting the first cord/lace end with the second cord/lace end, said clasp comprising:

a male portion; and a female portion;

each of the male and female portions including a cord-end/lace-end connection structure, said first cord/lace end being fitted to said male portion by means of said cord-end/lace-end connection structure of said male portion, and said second cord/lace end being fitted to said female portion by means of said cord-end/lace-end connection structure of said female portion;

the male and female portions including mutual connection structures for connecting together the male and female portions;

the male and female portions including complementary guiding structures for facilitating movement of the male and female portions into engagement and out of engagement, so as to close and open the clasp, respectively;

the guiding structure of the female portion comprising a longitudinally extending cavity;

the guiding structure of the male portion comprising a longitudinally extending sleeve adapted to be inserted and retained within said cavity of said female portion;

the length of the sleeve of the male portion being greater than or equal to an outermost transverse dimension of the sleeve of the male portion.

21. A connection system according to claim 20, wherein:

said complementary guiding structures for facilitating movement of the male and female portions into engagement and out of engagement, so as to close and open the clasp provide for a releasable connection for the clasp.

22. A connection system according to claim 20, wherein:

in a closed position of the clasp, the female portion has a proximal end in abutment against a facing surface of the male portion of the clasp at a transverse peripheral junction line.

23. An article of footwear comprising:

an upper having a lacing zone with a plurality of lacing guides extending longitudinally along the upper from a forward end to a rear end of the lacing zone;

a lace guided by the lacing guides within the lacing zone, the lace comprising at least first lace strand having a first lace end and a second lace strand having a second lace end;

a clasp for connecting the two ends of the lace to form a loop for exerting a traction force to tighten the article of footwear upon a foot of a wearer;

said clasp comprising:

a male portion; and a female portion;

each of the male and female portions including a lace-end connection structure, said first lace end being fitted to said male portion by means of said lace-end connection structure of said male portion, and said second lace end being fitted to said female portion by means of said lace-end connection structure of said female portion;

the lace-end connection structures of the male and female portions comprising respective channels for passage of the first and second lace ends, respectively, said male and female portions of the clasp further having respective shoulders for retaining knots formed in respective ones of said first and second lace ends;

the male and female portions including mutual connection structures for connecting together the male and female portions;

the male and female portions including complementary guiding structures for facilitating movement of the male and female portions into engagement and out of engagement, so as to close and open the clasp, respectively.

24. An article of footwear according to claim 23, wherein: each of said male and female portions has an envelope having the same outermost transverse cross-sectional dimension.

25. An article of footwear according to claim 24, wherein: the distal end of the envelope of each of the male and female portions has a tapered shape.

26. An article of footwear according to claim 23, wherein: each of said male and female portions has an envelope having the same outermost transverse cross-sectional dimension at least at a junction area between outer surfaces of said male and female portions in a closed/engaged position of the clasp.

27. An article of footwear according to claim 23, wherein: each of said male and female portions has an envelope having tapered distal ends.

28. A connection system according to claim 23, wherein: the guiding structure of the female portion comprising a longitudinally extending cavity;

the guiding structure of the male portion comprising a longitudinally extending sleeve adapted to be inserted and retained within said cavity of said female portion;

the length of the sleeve of the male portion being greater than or equal to a transverse outer dimension of the sleeve of the male portion.

29. An article of footwear according to claim 23, wherein: said complementary guiding structures for facilitating movement of the male and female portions into engagement and out of engagement, so as to close and open the clasp provide for a releasable connection for the clasp.

30. An article of footwear according to claim 23, wherein: in a closed position of the clasp, the female portion has a proximal end in abutment against a facing surface of the male portion of the clasp at a transverse peripheral junction line.

31. An article of footwear comprising:

an upper having a lacing zone with a plurality of lacing guides extending longitudinally along the upper from a forward end to a rear end of the lacing zone;

a lace guided by the lacing guides within the lacing zone, the lace comprising at least first lace strand having a first lace end and a second lace strand having a second lace end;

a clasp for connecting the two ends of the lace to form a loop for exerting a traction force to tighten the article of footwear upon a foot of a wearer;

said clasp comprising:

a male portion; and a female portion;

each of the male and female portions including a lace-end connection structure, said first lace end being fitted to said male portion by means of said lace-end connection structure of said male portion, and said second lace end being fitted to said female portion by means of said lace-end connection structure of said female portion;

the male and female portions including mutual connection structures for connecting together the male and female portions;

the male and female portions including complementary guiding structures for facilitating movement of the male and female portions into engagement and out of engagement, so as to close and open the clasp, respectively; and a lace blocker mounted on the first and second lace strands of the lace, the lace blocker being positioned between the lacing zone and the clasp, so that the wearer can apply a traction force on the loop to tighten the upper on the foot of the wearer.

32. An article of footwear according to claim 31, wherein:

the lace-end connection structures of the male and female portions comprising respective channels for passage of the first and second lace ends, respectively, said male and female portions of the clasp further having respective shoulders for retaining knots formed in respective ones of said first and second lace ends.

33. An article of footwear according to claim 31, wherein:

in a closed position of the clasp, the female portion has a proximal end in abutment against a facing surface of the male portion of the clasp at a transverse peripheral junction line.

* * * * *